US008568156B2

(12) United States Patent
Li et al.

(10) Patent No.: US 8,568,156 B2
(45) Date of Patent: Oct. 29, 2013

(54) LOCKING RECEPTACLE

(75) Inventors: Tetsuei Li, Tokyo (JP); Seigen Li, Tokyo (JP)

(73) Assignee: Goudougaisya Toyakohatsumei, Tokyo (JP)

( * ) Notice: Subject to any disclaimer, the term of this patent is extended or adjusted under 35 U.S.C. 154(b) by 529 days.

(21) Appl. No.: 12/997,216

(22) PCT Filed: Sep. 15, 2009

(86) PCT No.: PCT/JP2009/004618
§ 371 (c)(1),
(2), (4) Date: Dec. 9, 2010

(87) PCT Pub. No.: WO2010/038367
PCT Pub. Date: Apr. 8, 2010

(65) Prior Publication Data

US 2012/0067893 A1 Mar. 22, 2012

(30) Foreign Application Priority Data

Sep. 30, 2008 (JP) ..... 2008-276129
Feb. 12, 2009 (JP) ..... 2009-029223

(51) Int. Cl.
*H01R 13/62* (2006.01)

(52) U.S. Cl.
USPC ..... 439/372

(58) Field of Classification Search
USPC ..... 439/372, 310, 34, 261, 341–342, 835, 439/822, 483
See application file for complete search history.

(56) References Cited

U.S. PATENT DOCUMENTS 5,114,264 A * 5/1992 Barlow ..... 403/323
5,205,143 A * 4/1993 Hakkarainen et al. ..... 70/366

(Continued)

FOREIGN PATENT DOCUMENTS

JP 57-189472 A 11/1982
JP 2000-340286 A 12/2000
JP 4117344 B1 7/2008

OTHER PUBLICATIONS

International Search Report of the International Searching Authority (ISA/JPO) for PCT/JP2009/004618 dated Nov. 10, 2009.

*Primary Examiner* — Jean F Duverne
(74) *Attorney, Agent, or Firm* — The Law Office of Michael E. Kondoudis

(57) ABSTRACT

Provided is a novel technology for determining the cause of a faulty insertion of a block body into a plug blade insertion hole, and for solving that problem fundamentally. The externally extending shapes of a ceiling plate and a rotary frame are made circular by using the novel technology as the core technology, to thereby make improvements including the integration of a locking function and a power supply connection function. A selection is made which of a rotary frame (4) or a ceiling plate (22) is used as a reference, and a rotary track is set for the selected reference with the intersection of a longitudinal center line and a lateral center line used as the center of a circle. A new rotary track is provided for the other with the intersection of a lateral center line before rotation and a lateral center line after rotation used as the center of a circle in a state where the longitudinal center line is always aligned with the longitudinal center line of the selected reference. On the basis of that technology, both the rotary frame and ceiling plate are made circular so that power supply can be connected directly with the plug blade through the rotary frame (4), the block body, a substrate, or the like, which have the terminals of receptacle provided on the whole lengths of the rotation tracks thereof.

8 Claims, 9 Drawing Sheets

(56) References Cited

U.S. PATENT DOCUMENTS

| | | | | |
|---|---|---|---|---|
| 5,388,438 | A * | 2/1995 | Haavikko Paavo | 70/366 |
| 5,429,524 | A * | 7/1995 | Wakata et al. | 439/310 |
| 6,772,728 | B2 * | 8/2004 | Al-hawaj | 123/236 |
| 6,966,532 | B2 * | 11/2005 | Ishizaki et al. | 248/274.1 |
| 7,540,806 | B2 * | 6/2009 | Tastad | 463/46 |
| 7,995,332 | B2 * | 8/2011 | Ozolins et al. | 361/679.06 |
| 2001/0028853 | A1 * | 10/2001 | Hoyt | 417/355 |
| 2010/0024763 | A1 * | 2/2010 | Sparling | 123/200 |

* cited by examiner

LOCKING RECEPTACLE

TECHNICAL FIELD

The present invention relates to the structure and the function of an A-type receptacle (hereinafter, referred to as a receptacle) into which, among wiring plug-in connectors that connect a power source, a plug having two parallel plate-shaped plug blades is plugged and the invention includes a two-electrode connector body, a multi tap, a table tap, a corner tap, and the like into which the same plug is inserted.

BACKGROUND ART

Conventional receptacles have many problems such as inconvenience at the time of inserting and pulling the plug into and out of the receptacle, instability of power at the time when the pinching force of the receptacle terminals is weakened, likelihood of being in a halfway plugged state of the plug, incomplete locking state, and the like. In order to solve such problems, the following technical concept has been disclosed by the same inventors as those of the present invention.

RELATED ART DOCUMENT

Patent Document

Patent Document 1: U.S. Pat. No. 4,117,344

DISCLOSURE OF THE INVENTION

Problems to be Solved by the Invention

The above-described Patent Document relates to the same problems as those in an application which has been made by the inventors of the present invention, and the basic elements thereof are as follows. In the technical concept, plug blades 2*a* and 2*b* are inserted into a receptacle so as to be rotatable by about 90 degrees about the center of a predetermined circle in a predetermined track, receptacle terminals 16*a* and 16*b*, which serve as a power source, are disposed at positions where the terminals can be met when the plug is rotated by about 90 degrees, cylinder-shaped protruding portions 6*a* and 6*b* that can be inserted into and pass through plug blade holes 3*a* and 3*b* are synchronously rotated about the center of a different circle in a track different from that of the plug blades 2*a* and 2*b*. Therefore, the plug can be easily inserted into or pulled out of the receptacle, and when the plug blades 2*a* and 2*b* and a rotary frame 4 are rotated by about 90 degrees, the plug blades and the receptacle terminals 16*a* and 16*b* are brought into contact with each other so as to be electrically conducted together, and simultaneously, the cylinder-shaped protruding portions 6*a* and 6*b* are inserted into and pass through the plug blade holes 3*a* and 3*b* so as to fall into a locked state. The novelty and the inventive step of the technical concept have already been recognized (see claim 1 of Patent Document).

However, it could be understood that the specific technical means described in claim 1, claim 2, and claim 3 of the above-described Patent Document have a serious drawback. It could be understood that the drawback is a trouble that, when the plug is inserted into the receptacle and is rotated by about 90 degrees, the cylinder-shaped protruding portions 6*a* and 6*b* may not be smoothly inserted into the plug blade holes 3*a* and 3*b* under certain circumstances.

Means for Solving the Problems

The reason for easy occurrence of the trouble of the above-described Patent Document is that, in the above-described Patent Document, rotation is made in a fixed track with a rotary ceiling plate 19 used as a reference, and the rotation is made while the position of the center point of the cylinder-shaped protruding portions 6*a* and 6*b* disposed in the rotary frame 4 is changed, and, in a method of setting the track of the rotary frame 4, the rotary track of the rotary frame 4 is set using the center point of the protruding portions 6*a* and 6*b* directly as the center of a circle of the rotary frame 4. Then, when the positions of the rotary frame 4 and the rotary ceiling plate 19 are arranged, two circular tracks of the rotary ceiling plate 19 and the rotary frame 4 are devised to be disposed so as to be superimposed together on the lower right side of the circular track in the plan view so that the two circular tracks of the rotary frame 4 and the rotary ceiling plate 19 are positioned such that, before rotation, the protruding portions 6*a* and 6*b* are not inserted into the plug blade inserting holes 3*a* and 3*b* and, after rotation, the protruding portions 6*a* and 6*b* are inserted into and pass through the plug blade holes 3*a* and 3*b*. With such configuration, the above-described two circular tracks are in a state which is close to either of two states including a state before rotation and a state after rotation as possibly as can be (see Patent Document FIG. 1*a*, FIG. 1*b*, and FIG. 8). That is, it is configured such that the center point is moved by sliding between a center hole 7 disposed in the center portion of the rotary frame 4 and the protruding portion 23 disposed in the center rod 31 while the center point of the rotary frame 4 rotates (see page 4, $13^{th}$ line to $16^{th}$ line of the specification of the Patent Document), and thus the following three problems occur.

The first one is that there is a slight deviation between the vertical center line of the protruding portions 6*a* and 6*b* and the vertical center line of the plug blade holes 3*a* and 3*b* at a time point before rotation and a time point after rotation 5 and the size of the deviation becomes a factor of causing unsuccessful insertion of the protruding portions 6*a* and 6*b* into the plug blade holes 3*a* and 3*b* under certain circumstances at the time of rotation. The second one is that the vertical center lines of the rotary ceiling plate 19 and the rotary frame 4 are deviated from each other, and thus the protruding portions do not pass through the plug blade holes 3*a* and 3*b* up to a predetermined position by a way as much as the amount of deviation even when the protruding portions 6*a* and 6*b* are inserted into the plug blade holes 3*a* and 3*b*. The third one is that the extending shape of the rotary frame 4 of the above-described Patent Document is an approximate rectangle acquired by cutting both sides of a circular shape, the above-described two circular tracks are superimposed on the lower right side in the plan view, and the distance of the deviation of the vertical center lines is arranged so as to be divided on both sides; and accordingly, a gap (play space) is generated between the rotary frame track hole 9 and the double-arc shaped end portion of the rotary frame 4 (see FIG. 1*a* and 1*b* of Patent Document), and in some cases, the gap may be a factor of influencing the precision of the rotary track of the rotary frame 4.

In order to completely solve the problems of Patent Document mentioned as above and provide a locking receptacle without any trouble, according to the present invention, both rotary tracks of a rotary frame 4 that is provided with blocking bodies 3*a* and 3*b* and a ceiling plate 22 that is provided with plug blade inserting holes 2*a* and 2*b* are set by using a new method as described below.

First, one of the rotary frame 4 and the ceiling plate 22 is selected as a reference, and a rotary track of the one selected as the reference is set by using an intersection point of the vertical center line and the horizontal center line used as the center of a circle. In other words, the center point of the plug blade plugging openings 2*a* and 2*b* is directly used as the center of a circle of the ceiling plate 22 when the ceiling plate 22 is used as the reference, and the center point of the blocking bodies 3*a* and 3*b* is directly used as the center of a circle of the rotary frame 4 when the rotary frame 4 is used as the reference.

In addition, regarding the other thereof, while the vertical center line is maintained to be in a state of being coincident with the one used as the reference all the time from before rotation to after rotation, a new rotary track is arranged with use of the intersection point of the horizontal center line before rotation and the horizontal center line after rotation used as the center of a circle. Accordingly, either of both the ceiling plate 22 and the rotary frame 4 can be used as the reference. Further, among them, although whichever is used as the reference, if a plug is inserted into the receptacle and is rotated, the vertical center lines of both of them come to always automatically coincide with each other, the rotations of both of them are synchronous, and the blocking bodies 3*a* and 3*b* are moved by a predetermined distance so as to pass through the plug blade holes 14*a* and 14*b* smoothly and reliably.

Based on the technology, reformation is made such that both of the rotary track 4 and the ceiling plate 22 are made circular, the receptacle terminal 21 is provided all over the entire course of the rotary track of the plug blades 1*a* and 1*b*, direct electrical connection to the plug blades 1*a* and 1*b* is made through the rotary frame 4 or the blocking bodies 3*a* and 3*b* without separately arranging the receptacle terminal 22, the receptacle terminal is provided in a substrate 17 located below the rotary frame 4, and the like. The present invention solves the problems described above by using the above-described means, and exhibits the following advantages.

Effects of the Invention

The present invention, in the technology for achieving a locking function by inserting and passing the blocking bodies 3*a* and 3*b* into and through the plug blade holes 14*a* and 14*b*, determines the flaw in the above-described Patent Document which is likely to cause a problem to be the method of setting a rotary track and solves the object of inserting and passing the blocking bodies 3*a* and 3*b* into and through the plug blade holes 14*a* and 14*b* in a reliable manner by providing a new method of setting a track in which one of the rotary frame 4 and the ceiling plate 22 that serves as the reference uses directly the intersection point of the vertical center line and the horizontal center line as the center of a circle of the rotary track, and the remaining one uses the intersection point of the horizontal center line before rotation and the horizontal center line after rotation as the center of a circle. A specific means of the present invention for inserting the blocking bodies 3*a* and 3*b* into the plug blade holes 14*a* and 14*b* is to synchronously rotate the rotary frame 4 and the ceiling plate 22 about different centers of circles in different tracks. On the other hand, the above-described Patent Document discloses only the method in which the rotary frame 4 is rotated about the center of a circle that is different from that of the ceiling plate 22 while using the ceiling plate 22 used as the reference. Thus, according to the new method of setting a track according to the present invention, whichever of both of the rotary frame 4 and the ceiling plate 22 can be used as the reference, and therefore a technical void can be filled. Regarding the method of using a receptacle, there may be people who are acquainted with a familiar use method and feel it bothering to insert a plug into a receptacle and rotate the plug once. According to the present invention, besides a new type receptacle in which the plug is started to be electrically conducted when it is rotated, there is further provided a functional receptacle in which the receptacle terminal 21 is disposed over the entire course of the rotary track of the plug blades 1*a* and 1*b* so that the receptacle can be used with the conventional use method, and which is added with a new function of allowing a user to rotate the plug so that the plug enters a locked state when it becomes necessary. According to the present invention, through a series of alterations such as elimination of a separation plate in the structure of the receptacle, integration of the receptacle terminal 21 with the rotary frame 4, making the outlines of both the rotary track 4 and the ceiling plate 22 circular, providing the receptacle terminal 21 in a substrate 17 located below the rotary frame, and the like, many progresses have been made in the aspects of the theoretical rationalization and strictness, technical precision, and simplification of the structure, and the like.

BEST MODE(S) FOR CARRYING OUT THE INVENTION

Figure 1A:
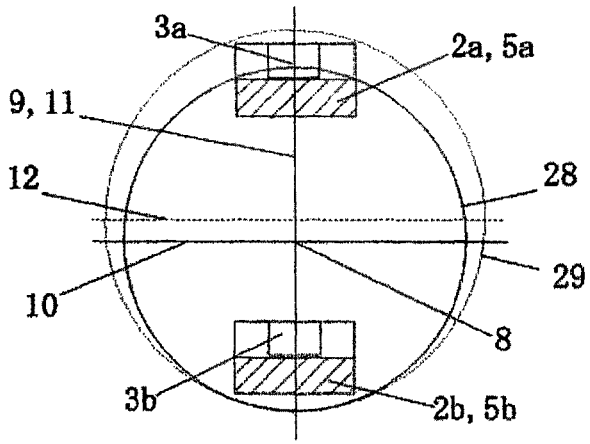
FIG. 1*a* is a plan view showing a positional relationship before rotation when a ceiling plate 22 is used as a reference.

A method of setting a track according to the present invention will be described first with reference to the drawings, with an example in which a ceiling plate 22 is used as a reference. In FIG. 1*a*, a rotary frame 4 is arranged on a ceiling plate 22 that is provided with plug blade plugging openings 2*a* and 2*b* in a before-rotation state in which blocking bodies 3*a* and 3*b* are not inserted into plug blade holes 14*a* and 14*b*.

Although the vertical center line 9 of the ceiling plate 22 coincides with the vertical center line 11 of the rotary frame 4, horizontal center lines 10 and 12 thereof do not coincide with each other. The ceiling plate 22 directly sets a rotary track with the center point 8 of the plug blade plugging openings 2*a* and 2*b* that is an intersection point of the vertical center line 9 and the horizontal center line 10 as the center of a circle of the ceiling plate. In this step, in order to show a positional change before and after rotation of the rotary frame 4, a temporary rotation track 29 is disposed.

Figure 1B:
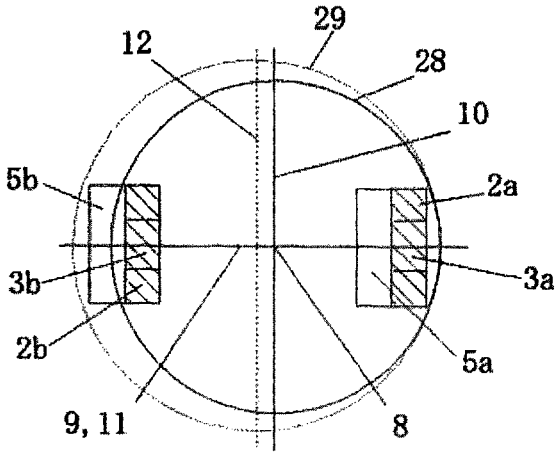
FIG. 1*b* is a plan view showing a positional relationship after rotation when the ceiling plate 22 is used as a reference.

In FIG. 1*b*, the blocking bodies are arranged in the rotary frame 4 in an after-rotation state in which the blocking bodies 3*a* and 3*b* are inserted into the plug blade holes 14*a* and 14*b*, to be in the state in which the above-described ceiling plate 22 is rotated by about 90 degrees. Likewise, although the vertical center lines 9 and 11 of both the ceiling plate 22 and the rotary frame 4 coincide with each other, the horizontal center lines 10 and 12 thereof do not coincide with each other. The rotation track 29 of the rotary frame 4 is a temporary track.

Figure 1C:
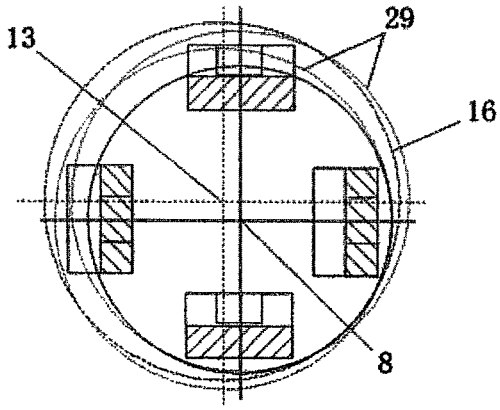
FIG. 1*c* is a plan view showing a positional change before and after rotation when the ceiling plate 22 is used as a reference.

FIG. 1*c* is obtained by superimposing FIG. 1*a* and FIG. 1*b* described above with a center line 8 used as a reference, whereby the positions before rotation, and positions after rotation of the rotary frame 4, the plug blade inserting holes 5*a* and 5*b*, and blocking bodies 3*a* and 3*b*, which are disposed in the rotary frame 4, are shown. In addition, the positions are fixed, and a new rotary track 16 that includes four spaces in which the plug blade inserting holes 5*a* and 5*b* and the blocking bodies 3*a* and 3*b*, which are fixed, is provided using an intersection point 13 of the horizontal center line 12 before rotation and the horizontal center line 12 after rotation as the center of a circle. Then, the shape of a rotary frame 4 is made in which the plug blade inserting holes 5*a* and 5*b* and the blocking bodies 3*a* and 3*b* are disposed at positions slightly deviated from the center of the circle and the vertical center line. The described above is the method of setting a track of the rotary frame 4 in the case in which the ceiling plate 22 is used as a reference (see FIG. 1*c* and FIG. 1*d*).

Now, in connection with the case in which the rotary frame 4 is used as the reference, a method of setting a rotary track of the ceiling plate 22 in which the plug blade plugging openings 2*a* and 2*b* are disposed will be described with reference to drawings. When the rotary frame 4 is used as the reference, basically, the setting method may be the opposite of that in the case of using the ceiling plate 22 the reference. In other words, the rotary frame 4 that is used as the reference sets a center point 6 of two square spaces in which the plug blade inserting holes 5*a* and 5*b* and the blocking bodies 3*a* and 3*b* are disposed as the center point 6 of the rotary frame 4 and the center of the circle of the rotary track.

Figure 2A:
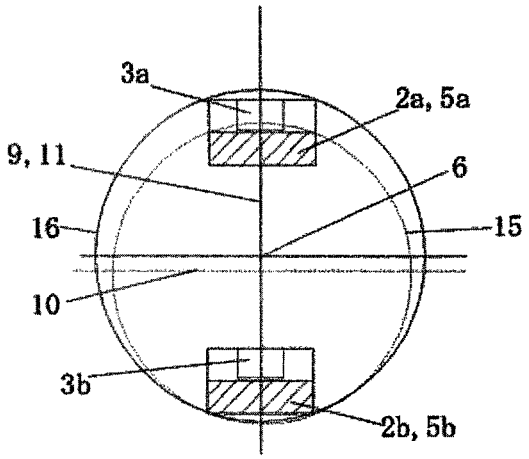
FIG. 2*a* is a plan view showing a positional relationship before rotation when the rotary frame 4 is used as a reference.
Figure 2B:
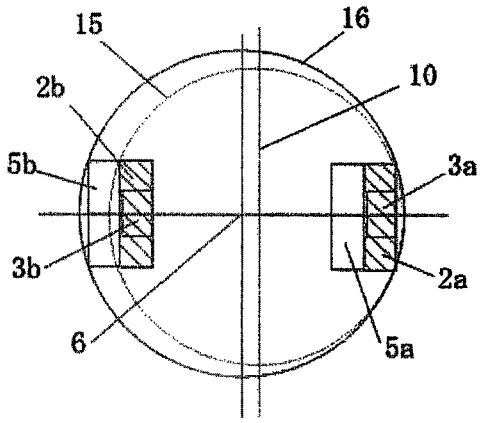
FIG. 2*b* is a plan view showing a positional relationship after rotation when the rotary frame 4 is used as a reference.
Figure 2C:
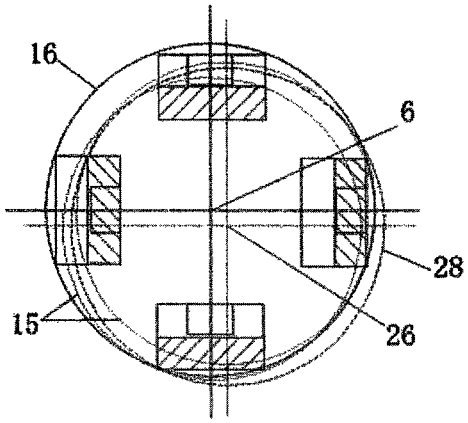
FIG. 2*c* is a plan view showing a positional change before and after rotation when the rotary frame 4 is used as a reference.
Figure 2D:
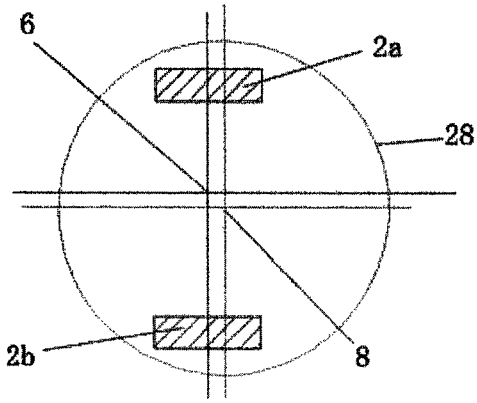
FIG. 2*d* is a plan view showing the shape of the ceiling plate 22 when the rotary frame 4 is used as a reference.

As shown in FIG. 2*a*, the ceiling plate 22 is arranged in a state in which the blocking bodies 3*a* and 3*b* are not inserted into the plug blade holes 14*a* and 14*b* in the state in which the rotary frame 4 has not yet been rotated, and then as shown in FIG. 2*b*, the blocking bodies are arranged in a state in which the blocking bodies 3*a* and 3*b* are inserted into the plug blade holes 14*a* and 14*b* in the state in which the rotary frame 4 is rotated by about 90 degrees. Then, the center points 6 that are shown in FIG. 2*a* of the before-rotation state and FIG. 2*b* of the after-rotation state are superimposed. Then, since four positions before rotation and after rotation of the plug inserting holes 2*a* and 2*b* appear, the positions are determined, and a rotary track 28 of the ceiling plate 22 is set so as to include four positions of the plug blade plugging openings 2*a* and 2*b* before and after rotation, which are determined as described above, with an intersection point 26 between the horizontal center lines 10 of the states before and after rotation of the ceiling plate 22 set as the center of a circle. Then, when an appropriate outer-edge protruding periphery 23 is arranged in the circular shape of the rotary track 28, the shape of the ceiling plate 22 is formed (see FIG. 2*a*, FIG. 2*b*, FIG. 2*c*, and FIG. 2*d*).

According to the present invention, track setting is performed by using the above-described method, thus, any of the ceiling plate 22 and the rotary frame 4 can be used as a reference. Whichever is used as the reference, when a plug is rotated with being inserted into a receptacle, the vertical center lines of both of them naturally coincide with each other all the time, rotation of both of them becomes synchronous, and accordingly, the blocking bodies 3*a* and 3*b* are reliably moved by a predetermined distance and are inserted into and pass through the plug blade holes 14*a* and 14*b* smoothly and reliably.

Although it is not impossible to use a method other than the above-described track setting method, for example, the method in which any of the ceiling plate and the rotary frame is not used as a reference, the vertical center lines thereof do not coincide with each other, and the deviation distance of the center point is separately set for the ceiling plate and the rotary frame, in such case, there is no particular advantage but the design thereof becomes more complex because the vertical center lines of both of them need to be set again, and furthermore the method is merely a theory that is the same as the above-described setting method, whereby the method is not proposed. Several embodiments for implementing the track setting method according to the present invention, starting from a first embodiment, will be described in detail with reference to drawings.

First Embodiment

Figure 1D:
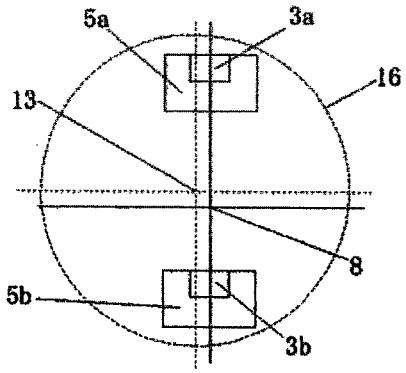
FIG. 1*d* is a plan view showing the shape of a rotary frame 4 when the ceiling plate 22 is used as a reference.
Figure 5:
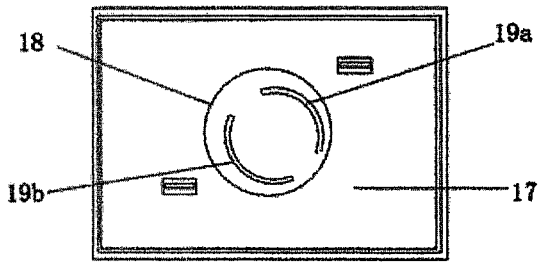
FIG. 5 is a plan view showing plug blade track grooves 19*a* and 19*b*.

The bottom layer of the receptacle is formed from a substrate 17, the center portion of the substrate 17 is formed as a circular concave portion that coincides with the rotary track 16 of the rotary frame shown in the above-described FIG. 1*d*, and the peripheral wall of the concave portion is formed to protrude upright so as to become a track wall 18 of the rotary frame. In a concave portion at the center of the rotary frame track wall 18, the surface of the substrate 17 is provided with plug blade track grooves 19*a* and 19*b*, which are in conformity with the shapes of the tracks of the plug blades 1*a* and 1*b* at the time when the plug is rotated with being inserted into a receptacle and the shapes of the tip end portions of the plug blades, and are concaved (see FIG. 5).

Figure 3:
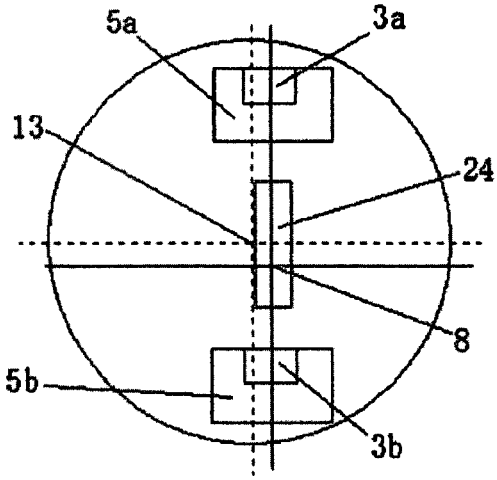
FIG. 3 is a plan view showing the shape of the rotary frame 4 when the ceiling plate 22 is used as a reference.

Then, the rotary frame 4 is fitted into the inside of the rotary frame track wall 18 so as to be freely rotatable. In the rotary frame 4, within a circular fame, as shown in FIG. 3, the plug blade inserting holes 5*a* and 5*b* and the blocking bodies 3*a* and 3*b* are disposed within a quadrangular space at positions slightly deviated from the center point 8 of the circular frame that is set according to the track setting method of the present invention, and a protruding portion 24 is disposed to protrude in the center portion of the frame. In addition, receptacle terminals 21*a* and 21*b*, which become a power source, formed form a conductor having elasticity such as copper are disposed on one side or both sides of the entire course of the rotary track of the plug blades 1*a* and 1*b* up to a position that is apart as much as the distance of rotation of 90 degrees from the positions of the time at which the plug blades 1*a* and 1*b* are inserted into the receptacle, on the substrate 17 into which the rotary frame 4 is fitted (see FIG. 3 and FIG. 4).

Although the ceiling plate 22 is disposed on the upper side of the receptacle terminals 21*a* and 21*b*, the plug blade plugging openings 2*a* and 2*b* are formed through the ceiling plate 22 on a circular plate, the circular plate protruding periphery 23 is disposed on the periphery of the circular plate, a quadrangular protruding portion 20 is suspended from the center portion of the rear face of the circular plate, the ceiling plate protruding portion 20 allows the protruding portion 24, which is formed to protrude in the center portion of the rotary frame 4, to be fitted into the inside thereof and forms a hollow-state space in which sliding can be performed up to a predetermined distance on the inside thereof.

Although the uppermost layer is disposed so as to cover a cover 25, a ceiling plate fitting hole 27 is formed in the cover 25. At the time point of assembly, although the plug blade plugging openings 2*a* and 2*b* formed in the ceiling plate 22 coincide with the plug blade inserting openings 5*a* and 5*b* formed in the rotary frame 4 and the positions of the plug blade track grooves 19*a* and 19*b* before rotation that are formed in the substrate 17; the positions of the center point 8 of the ceiling plate 22 and the center point 6 of the rotary frame 4 are slightly deviated from each other (see FIG. 1*d*).

In the above-described embodiment, the basic structure is the same as in the case in which the ceiling plate 22 is used as the reference and in the case in which the rotary frame 4 is used as the reference, and a difference therebetween is that the positions of the plug blade inserting holes 5*a* and 5*b* of the rotary frame 4 and the blocking bodies 3*a* and 3*b* are slightly deviated from the center point of the rotary frame 4 in the case in which the ceiling plate 22 is used as the reference, and the positions of the plug blade plugging openings 2*a* and 2*b* are slightly deviated from the center point of the ceiling plate 22 in the case in which the rotary frame 4 is used as the reference.

In any of the cases, at the time point of assembly of the receptacle, although the positions of the plug blade inserting openings 5*a* and 5*b* formed in the rotary frame 4 and the plug blade plugging openings 2*a* and 2*b* formed in the ceiling plate 22 coincide with each other, the center point of the rotary frame 4 and the center point of the ceiling plate 22 are slightly deviated from each other. At the time of manufacture according to the present invention, by selectively using a metallic conductor and a non-conductive material such as a synthetic resin that has heat resistance, strength, and durability, occurrences of short-circuit or ignition in a power source, melting of coating, a tracking phenomenon, and the like are prevented, and the shape of the cover can be changed depending the type or use of the receptacle.

The invention is made with the above-described structure. At the time of using this, if the plug blades 1*a* and 1*b* are inserted into the plug blade plugging openings 2*a* and 2*b* formed in the ceiling plate 22, the plug blades 1*a* and 1*b* pass through the receptacle terminals 21*a* and 21*b* and the plug blade inserting openings 5*a* and 5*b* formed in the rotary frame 4, and the tip end portions thereof are inserted up to the plug blade track grooves 19*a* and 19*b* formed in the substrate 17. At this time point, the plug blades 1*a* and 1*b* are already pinched by or brought into contact with the receptacle terminals 21*a* and 21*b* so as to be in an electrically conducted state, and accordingly, this can be used in the same manner as a conventional receptacle.

When the receptacle is desired to be in a locking state, the plug is rotated by about 90 degrees in the clockwise direction while it is inserted into the receptacle. Then, the plug blades 1*a* and 1*b* are rotated together with the ceiling plate 22 while sliding in the state of being pinched by the receptacle terminals 21*a* and 21*b*, and simultaneously, by a compressing action to side walls of the plug blade inserting holes 5*a* and 5*b* formed in the rotary frame 4 of the plug blades 1*a* and 1*b* and an interlocking action between the protruding portion 24 and the ceiling plate protruding portion 20, the rotary frame 4 start to synchronously rotate in a state in which the plug blades 1*a* and 1*b* and the vertical center lines 9 and 11 coincide with each other (regarding the rotation direction of the plug, although the plug can be rotated in a counterclockwise direction, it is convenient to rotate the plug in the clockwise direction for a right-handed person).

However, since the position of the center of the circle of the ceiling plate 22 in which the plug blade plugging openings 2*a* and 2*b* are formed and the position of the center of the plug blade track grooves 19*a* and 19*b* formed in the substrate 17 are different from the position of the center of the circle of the rotary frame 4, the center point of the blocking bodies 3*a* and 3*b* moves while they rotate in synchronization with the plug blades 1*a* and 1*b*, and at a time point when the blocking bodies are rotated by about 90 degrees, the blocking bodies 3*a* and 3*b* are fully inserted into and pass through the plug blade holes 14*a* and 14*b*.

Figure 4:
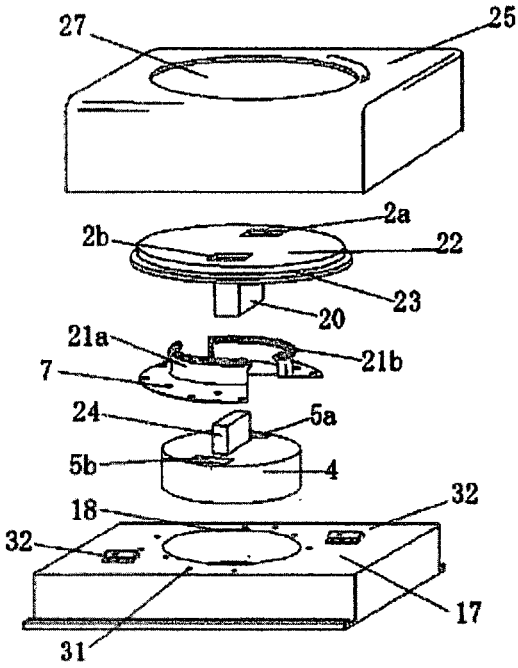
FIG. 4 is an exploded perspective view of a first embodiment.
Figure 10:
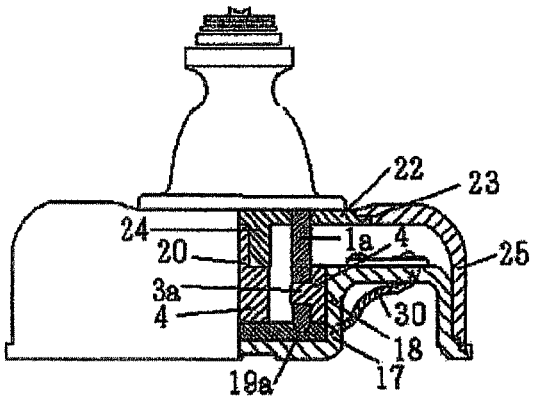
FIG. 10 is a central cross-sectional view of a fourth embodiment.

When the blocking bodies 3*a* and 3*b* are inserted into and pass though the plug blade holes 14*a* and 14*b*, the blocking bodies 3*a* and 3*b* are locked in the rotary frame 4 because the blocking bodies 3*a* and 3*b* have a cylinder shape, the receptacle terminals 21*a* and 21*b* are engaged with the rotary frame 4 with use of screws, and the protruding periphery 23 of the ceiling plate 22 is fitted into the receptacle cover 25, whereby the plug blades 1*a* and 1*b* are in a completely locked state (see FIG. 4 and FIG. 10).

When the plug is removed from the receptacle, if the plug is turned back in the counterclockwise direction that is a direction opposite to the above-described direction, the blocking bodies 3*a* and 3*b* are detached from the plug blade holes 14*a* and 14*b* so as to be released from being locked, and accordingly, that is, it becomes a state in which the plug can be pulled out.

In this embodiment, although the area where the plug blades 1*a* and 1*b* are pinched by the receptacle terminals 21*a* and 21*b* may be about less than a half of that of a conventional receptacle and thus a resistance depending on the pinching force of the receptacle terminal 21*a* and 21*b* at the time of plugging-in or pulling-out is weak, the plug blades 1*a* and 1*b* are in the state of being pinched by the receptacle terminals 21*a* and 21*b* while they receive locking actions of the plug blade plugging openings 2*a* and 2*b* of the ceiling plate, the plug blade inserting holes 5*a* and 5*b* of the rotary frame 4, and the plug blade track grooves 19*a* and 19*b* formed in the substrate 17 in several places. Accordingly, the stability is high, the plug blades 1*a* and 1*b* are not loosened or in a half way plugged state, and the operation can be simple. Therefore it can be used in the same manner as a conventional receptacle while solving the problems of the conventional receptacle.

When a plug is not inserted into the receptacle, the rotary frame 4 is not freely rotated, and the positions of the plug blade plugging openings 2*a* and 2*b* are not freely moved thanks to on an appropriate frictional force between the outer wall face of the rotary frame 4 and the rotary frame track wall 18 and a locking action of the ceiling plate protruding portion 20 for the protruding portion 24.

Second Embodiment

Figure 6:
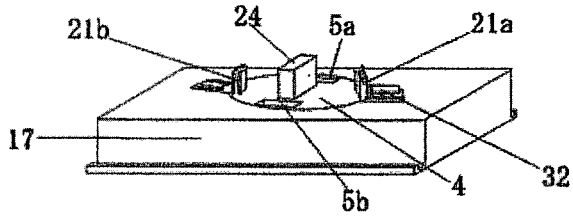
FIG. 6 is a perspective view showing receptacle terminals 21*a* and 21*b* of a second embodiment.

In this embodiment, differently from the above-described first embodiment in which, regarding the installation positions of the power source connecting receptacle terminals 21*a* and 21*b*, the receptacle terminals 21*a* and 21*b* are disposed over the entire course of the plug blade rotary track 28, from the positions at the time of insertion of the plug blades 1*a* and 1*b* into the receptacle to the positions at which the plug blades are rotated by about 90 degrees, by disposing the power connecting receptacle terminals 21*a* and 21*b* at positions at which the plug blades 1*a* and 1*b* on the substrate 17 are rotated by about 90 degrees, the plug blades are not electrically conducted at a time point when the plug blades 1*a* and 1*b* are inserted into the receptacle, and when the plug blades 1*a* and 1*b* are rotated by about 90 degrees, the plug blades 1*a* and 1*b* are brought into contact with or pinched by the receptacle terminals 21*a* and 21*b* to be in an electrically conducted state, and simultaneously, the blocking bodies 3*a* and 3*b* are inserted into and pass through the plug blade holes 14*a* and 14*b* so as to be in a locked state, and when the plug is returned to the original insertion position, the blocking bodies 3*a* and 3*b* are pulled out from the plug blade holes 14*a* and 14*b* so as to release the locked state, and simultaneously, the plug blades 1*a* and 1*b* are detached from the receptacle terminals 21*a* and 21*b* so as to cut off the power. The other portions are similar to those of the first embodiment (See FIG. 5 and FIG. 6).

Third Embodiment

Figure 7A:
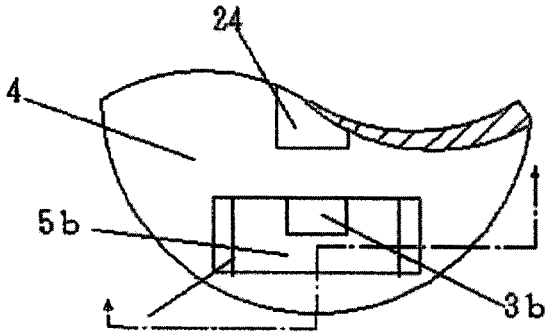
FIG. 7*a* is a plan view for showing where the cross-sectional view of a rotary frame 4 is taken.
Figure 7B:
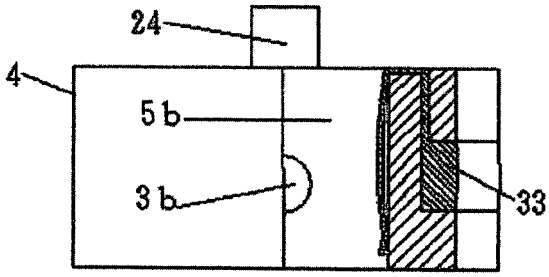
FIG. 7*b* is a local cross-sectional view of the center portion of a rotary frame 4 of a third embodiment.
Figure 8:
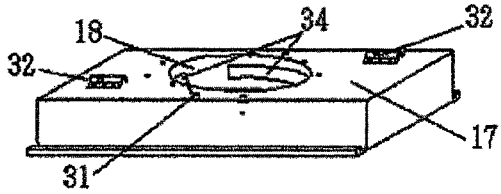
FIG. 8 is a perspective view showing a power source electrical conductor 34 of the third embodiment.
Figure 9:
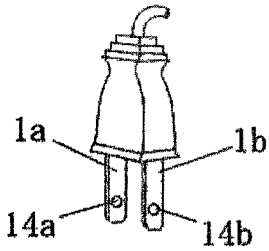
FIG. 9 is a perspective view of a plug.

In this embodiment, without separately arranging the power connecting receptacle terminals 21*a* and 21*b*, by integrating the receptacle terminals 21*a* and 21*b* and the rotary frame 4 together, the direct power source to the rotary frame 4 is achieved via the plug blades 1*a* and 1*b* and the blocking bodies 3*a* and 3*b*. Accordingly, on both sides of a through space in which the plug blade inserting holes 5*a* and 5*b* and the blocking bodies 3*a* and 3*b* are disposed, a conductor 33 such as a copper piece that has elasticity is disposed, and the conductor 33 is exposed to the surface of the rotary frame 4 so as to be able to be connected to the rotary track wall 18. Also the rotary track wall 18 is provided with the conductor 33 that is connected with the power source even when it is exposed from the surface of the rotary frame 4(see FIG. 7 and FIG. 8).

In addition, the installation position or an installation means of the conductor 34 that is disposed in the track wall 18 may be changed depending the type of the receptacle. For example, in the case of a type that is electrically conductive from a time point when the plugs are inserted into the receptacle, similar to the first embodiment, the conductor 34 is arranged over the entire course of the rotary tract of the rotary track wall 18 that is connected to the rotary frame 4. In a type that starts to be conductive when the plug blades 1*a* and 1*b* are rotated by 90 degrees, similar to the second embodiment, the conductors 34 may be arranged at positions at which the plugs 1*a* and 1*b* are rotated by about 90 degrees (see FIG. 8).

In this embodiment, since the receptacle terminals 21*a* and 21*b*, the blocking bodies 3*a* and 3*b*, and the rotary frame 4 are integrally formed and the conductor, instead of the receptacle terminal 21, is incorporated in the inside of the rotary frame track wall 18 and the rotary frame 4, this embodiment is not greatly different from the first embodiment and the second embodiment described above in terms of the function but the structure thereof is more simplified. This leads to improvement in the degree of difficulty of production and reduction of the costs. The position or means for disposing the conductor that serves as a power source is not limited to that described above. The others are similar to those of the first embodiment and the second embodiment described above (see FIG. 8).

Fourth Embodiment

Differently from the above-described embodiment in which the receptacle terminals 21*a* and 21*b* that serve as a power source are disposed on the upper side of the rotary frame 4 or the rotary frame 4 and the blocking bodies 3*a* and 3*b* are integrally arranged, in this embodiment, the receptacle terminals 21*a* and 21*b* are integrated with the plug blade track grooves 19*a* and 19*b* on the substrate 17 that is located on the lower side of the rotary frame 4. Although this embodiment has a structure in which the plug blade track grooves 19*a* and 19*b* are formed from metallic conductors such as copper, and the power source is connected thereto, and thus the tip end portions of the plug blades are brought into contact with or pinched by the plug blade track grooves 19*a* and 19*b* so as to be electrically conducted at a time point when the plug blades 1*a* and 1*b* are inserted into the receptacle, when the positions to be electrically conducted are configured to be over the entire course of the rotary track of the plug blade track grooves 19*a* and 19*b*, the plug blades are electrically conducted at a time point when the plugs are inserted into the receptacle, and similarly to the first embodiment described above, the same use method as that of a conventional receptacle can be used, and when the plugs are arranged so as to be electrically conducted at a position at which the plug is rotated by about 90 degrees, similarly to the second embodiment described above, the type that starts to be electrically conducted by rotating the plug is formed. The others are the same as those of the first embodiment or the second embodiment described above.

However, in the case of this embodiment, the plug blade track grooves 19*a* and 19*b* and the receptacle terminals are integrally formed, and a specific method thereof is not limited to that described above, at any rate, since this embodiment uses a structure in which the tip end portions of the plug blades are brought into contact with or pinched by the plug blade track grooves 19*a* and 19*b* so as to be electrically conducted, a contact portion for connecting the power source to the plug blade is only the tip end portion of the plug blade. Accordingly, the way of improving the degree of tightness and the stability of connection needs to be studied (see FIG. 4 and FIG. 10).

INDUSTRIAL APPLICABILITY

The present invention, as a technology relating to a locking receptacle, can be broadly used as a home appliance or an electric apparatus.

EXPLANATIONS OF LETTERS OR NUMBERS

1*a*, 1*b*: PLUG BLADE
2*a*, 2*b*: PLUG BLADE PLUGGING OPENING
3*a*, 3*b*: BLOCKING BODY
4: ROTARY FRAME
5*a*, 5*b*: PLUG BLADE INSERTING HOLE
6: ROTARY FRAME CENTER POINT
7: SCREW HOLE
8: CENTER POINT OF CEILING PLATE
9: VERTICAL CENTER LINE OF CEILING PLATE
10: HORIZONTAL CENTER LINE OF CEILING PLATE
11: VERTICAL CENTER LINE OF ROTARY FRAME
12: LATERAL CENTER LINE OF ROTARY FRAME
13: INTERSECTION POINT OF HORIZONTAL CENTER LINE OF ROTARY FRAME
14: PLUG BLADE HOLE
15: CEILING PLATE-INSTALLED ROTARY TRACK
16: ROTARY TRACK OF ROTARY FRAME
17: SUBSTRATE
18: TRACK WALL OF ROTARY FRAME
19*a*, 19*b*: PLUG BLADE TRACK GROOVE
20: CEILING PLATE PROTRUDING PORTION
21*a*, 21*b*: RECEPTACLE TERMINAL
22: CEILING PLATE

23: PROTRUDING PERIPHERY OF CEILING PLATE
24: PROTRUDING PORTION
25: RECEPTACLE COVER
26: INTERSECTION POINT OF HORIZONTAL CENTER LINE OF CEILING PLATE
27: CEILING PLATE FITTING HOLE
28: CEILING PLATE ROTARY TRACK
29: TEMPORARY ROTARY TRACK OF ROTARY FRAME
30: ELECTRIC LINE
31: SCREW HOLE
32: ELECTRIC LINE CONNECTING PORTION
33: POWER SOURCE CONDUCTOR
34: POWER SOURCE CONDUCTOR

The invention claimed is:

1. A locking receptacle, comprising:

blocking bodies that can be inserted into and pass through plug blade holes by rotating a ceiling plate in which plug blade plugging openings are arranged and a rotary frame in which the blocking bodies are arranged together about different circle centers in different tracks by about 90 degrees, wherein rotary tracks of the ceiling plate and the rotary frame are set such that when a vertical center line of the ceiling plate and a vertical center line of the rotary frame are always coincident with each other, one of the rotary tracks has an intersection point of the vertical center line and a horizontal center line as its circle center, and another of the rotary tracks has an intersection point of the horizontal center line before rotation and the horizontal center line after rotation as its circle center.

2. The locking receptacle of claim 1, wherein the ceiling plate is rotated in a track having a center point that is an intersection point of the vertical center line and a horizontal center line as its circle center, and wherein the rotary frame, when the vertical center line of the rotary frame always coincides with the vertical center line of the ceiling plate, arranges a rotary track that has an intersection point of a horizontal center line before rotation and the horizontal center line after rotation as its circle center.

3. The locking receptacle of claim 1, wherein the rotary frame rotates in a track having a center point that is an intersection point of the vertical center line of the rotary frame and a horizontal center line as its circle center, and wherein the ceiling plate, when the vertical center line of the celing plate always coincides with the vertical center line of the rotary frame, arranges a rotary track that has an intersection point of a horizontal center line of the ceiling plate in before rotation in which the blocking bodies are not inserted into the plug blade holes and the horizontal center line of the ceiling plate after rotation in which the blocking bodies are inserted into the plug blade holes as its circle center.

4. The locking receptacle of claim 1, wherein the rotary tracks are set such that, when the vertical center line of the ceiling plate and the vertical center line of the rotary frame are always coincident with each other, one of the rotary tracks has an intersection point of the vertical center line and the horizontal center line as its circle center, and another of the rotary tracks has an intersection point of the horizontal center line before rotation and the horizontal center line after rotation as its circle center, wherein power source connecting receptacle terminals are disposed over an entire course of the one of the rotary tracks that is away from a position where plug blades of a plug are inserted into the receptacle to a position where the plug blades and are rotated by about 90 degrees, and wherein the plug is electrically conducted from a time point when the plug is inserted into the receptacle and is switched to a locked state from an electrically conducted state when the plug is rotated by about 90 degrees.

5. The locking receptacle of claim 1, wherein the rotary tracks are set such that, when the vertical center line of ceiling plate and the vertical center line of the rotary frame are always coincident with each other, one of the rotary tracks has an intersection point of the vertical center line and a horizontal center line as its circle center, and another of the rotary tracks has an intersection point of the horizontal center line before rotation and the horizontal center line after rotation as its circle center, wherein power source connecting receptacle terminals are disposed at positions at which plug blades of a plug are inserted into the receptacle and are rotated by about 90 degrees, wherein, when the plug is rotated by about 90 degrees in a first direction from an insertion position, the plug is electrically conducted and simultaneously falls in a locked state, and wherein, when the plug is rotated by about 90 degrees in a second direction opposite the first direction from the insertion position, the plug is released, and a power source is disconnected.

6. The locking receptacle of claim 1, wherein power source connecting receptacle terminals are integrally formed with the rotary frame, and wherein a plug is electrically conducted via the rotary frame or the blocking bodies.

7. The locking receptacle of claim 1, wherein power connecting receptacle terminals are integrated with plug blade track grooves that are arranged in a receptacle substrate, and wherein a plug is electrically conducted in an entire course of the rotary track of the plug blades of the plug blade track grooves or at a position at which the plug blades are rotated by about 90 degrees.

8. The locking receptacle of claim 1, wherein the ceiling plate and the rotary frame have circular extending shapes.

* * * * *